United States Patent [19]

Brown

[11] 4,357,912

[45] Nov. 9, 1982

[54] ENGINE COOLING SYSTEM

[75] Inventor: Peter W. Brown, North Muskegon, Mich.

[73] Assignee: Outboard Marine Corporation, Waukegan, Ill.

[21] Appl. No.: 206,019

[22] Filed: Nov. 12, 1980

[51] Int. Cl.[3] ..... F01P 7/14

[52] U.S. Cl. ..... 123/41.08; 440/900

[58] Field of Search ..... 123/41.08, 41.09, 198 D, 123/41.13; 137/115, 495; 251/61.5; 440/2, 84, 88, 900; 236/101 C, 34.5

[56] References Cited

U.S. PATENT DOCUMENTS

| | | | |
|---|---|---|---|
| 2,989,282 | 6/1961 | White | 251/61.5 X |
| 3,667,431 | 6/1972 | Kueny et al. | 123/41.08 |
| 3,918,418 | 11/1975 | Horn | 123/41.08 |
| 4,140,089 | 2/1979 | Kueny et al. | 123/41.08 |

*Primary Examiner*—William A. Cuchlinski, Jr.
*Attorney, Agent, or Firm*—Michael, Best & Friedrich

[57] ABSTRACT

Disclosed herein is a marine propulsion device including an internal combustion engine having a water jacket with an inlet portion, a second portion, and a valve port communicating between the inlet portion and the second portion, a valve member movable relative to the valve port between open and closed positions, a recess extending from the inlet portion, a movable wall connected to the valve member for actuation thereof between the open and closed positions, which movable wall has opposite first and second sides and extends across the recess to define, on the first side thereof, a chamber located in the recess, and being subject, on the second side thereof, to the pressure of the water in the inlet portion, a water pump driven by the engine, having a discharge outlet, and communicating with the water during normal operation, a water supply conduit communicating with the discharge outlet and with the water jacket inlet portion, and including an overboard discharge branch conduit communicating with the atmosphere, a duct communicating with the chamber and with the overboard discharge branch conduit, and a valve in the overboard discharge branch conduit downstream of the connection with the duct and operable selectively to open and close the overboard discharge branch conduit relative to the atmosphere.

14 Claims, 2 Drawing Figures

ENGINE COOLING SYSTEM

BACKGROUND OF THE INVENTION

The invention relates generally to internal combustion engines and to cooling systems therefor.

The invention relates more particularly to marine propulsion devices such as outboard motors and stern drive units, including internal combustion engines and cooling systems therefor.

Attention is directed to the Kueny U.S. Pat. No. 3,667,431 issued June 6, 1972 and to the Kueny et al U.S. Pat. No. 4,140,089 issued Feb. 20, 1979.

In the past, cooling systems of marine engines have included both a thermostatically controlled valve and a pressure actuated valve, often arranged in parallel, for controlling coolant flow from one portion of a coolant jacket to another. Such thermostatic valves opened upon the attainment of predetermined temperature conditions in the coolant and such pressure actuated valves opened upon the attainment of predetermined pressure conditions in the coolant. No arrangement was available for varying the levels of either the temperature or pressure at which the valves would open.

SUMMARY OF THE INVENTION

The invention provides a marine propulsion device comprising a power head including an internal combustion engine having a water jacket with an inlet portion, a second portion, and a valve port communicating between the inlet portion and the second portion, a valve member movable relative to the valve port between open and closed positions, a recess extending from the inlet portion, a movable wall connected to the valve member for actuation thereof between the open and closed positions, which movable wall has opposite first and second sides and extends across the recess to define, on the first side thereof, a chamber located in the recess, and being subject, on the second side thereof, to the pressure of the water in the inlet portion, and a lower unit connected to the power head and including a propeller submerged in water during normal operation, a water pump driven by the engine, having a discharge outlet, and communicating with the water during normal operation, a water supply conduit communicating with the discharge outlet and with said inlet portion of the water jacket, which water supply conduit includes an overboard discharge branch conduit communicating with the atmosphere, a duct communicating with the chamber and with the overboard discharge branch conduit, and valve means in the overboard discharge branch conduit downstream of the connection with the duct and operable selectively to open and close the overboard discharge branch conduit relative to the atmosphere.

The invention also provides an internal combustion engine comprising a coolant jacket including an inlet portion and a second portion, pressure actuated valve means including a valve port communicating between said inlet portion and said outlet portion of said coolant jacket, a valve member movable relative to the valve port between open and closed positions, and means subject to the application of pressure independent of the coolant pressure in the inlet portion for effecting movement of the valve member between the open and closed positions, and means for selectively applying pressure to the means for effecting movement of the valve member.

In one embodiment of the invention, the means for effecting movement of the valve member comprises a recess extending from the inlet portion, and a movable wall connected to the valve member for actuation thereof between the open and closed positions, which movable wall has opposite first and second sides and extends across the recess to define, on the first side thereof, a chamber located in the recess and being subject, on the second side thereof, to the pressure of the coolant in the inlet portion.

In one embodiment of the invention, the means for selectively applying pressure comprises means for selectively supplying pressure fluid to the chamber.

In one embodiment of the invention, the means for selectively supplying pressure fluid to the chamber comprises conduit means communicating with the chamber and adapted for connection to a source of pressure fluid, and valve means communicating with the conduit means and operable selectively to open and close the conduit means relative to the atmosphere.

In one embodiment of the invention, the valve means comprises a solenoid operated valve which is normally closed and which is opened in response to increasing engine speed.

In one embodiment of the invention, the valve means is located in a branch conduit communicating between the conduit means and the atmosphere.

In one embodiment of the invention, the recess includes a far wall and the means for effecting movement of the valve member includes a spring acting between the first side of the diaphragm and the far wall of the recess.

In one embodiment of the invention, the movable wall comprises a flexible diaphragm.

In one embodiment of the invention, the invention further includes a bypass duct connected to the branch conduit and extending in by-passing relation to the valve means and has therein restriction means for continuously permitting a limited flow of water through the bypass duct.

Other features and advantages of the embodiments of the invention will become known by reference to the following general description, claims and appended drawings.

IN THE DRAWINGS

Figure 1:
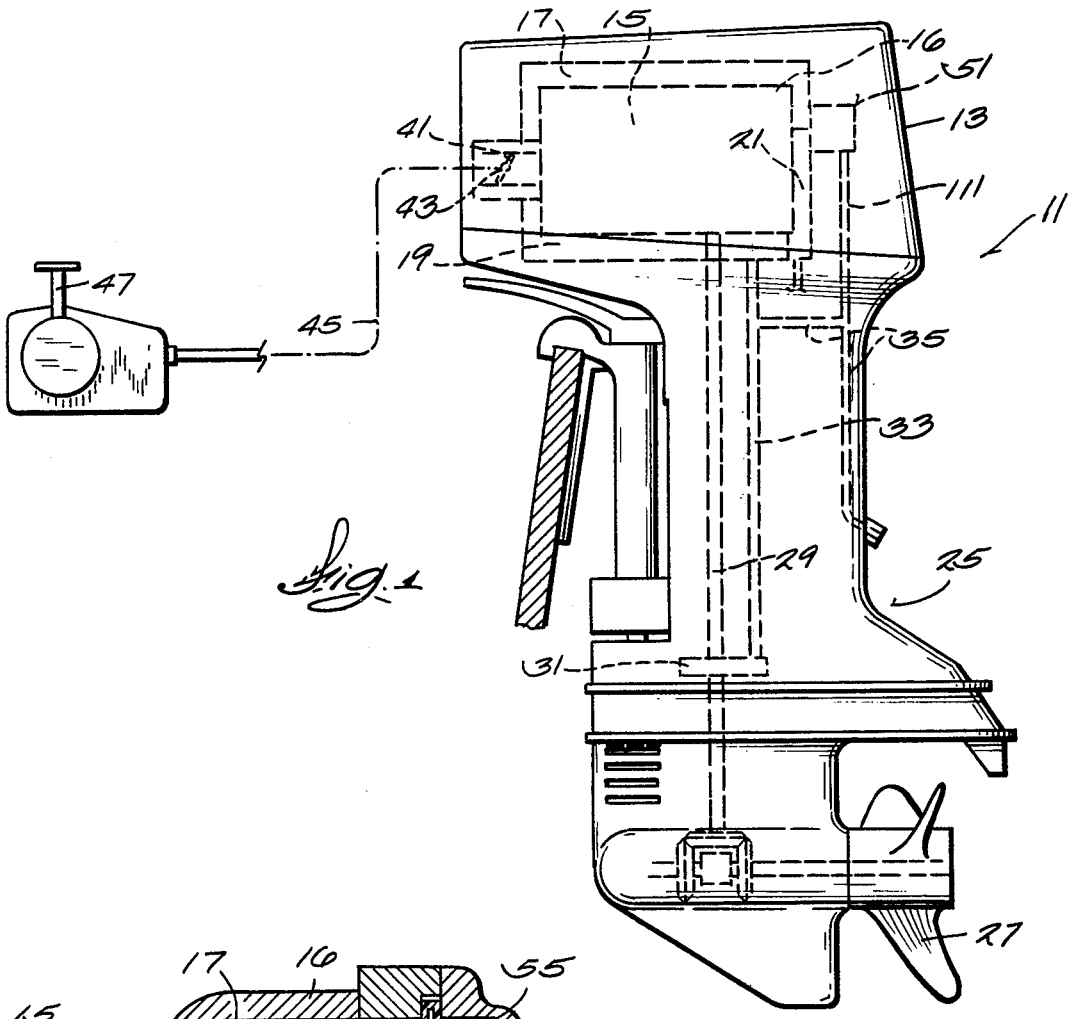
FIG. 1 is a partially schematic perspective view of an outboard motor embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 2:
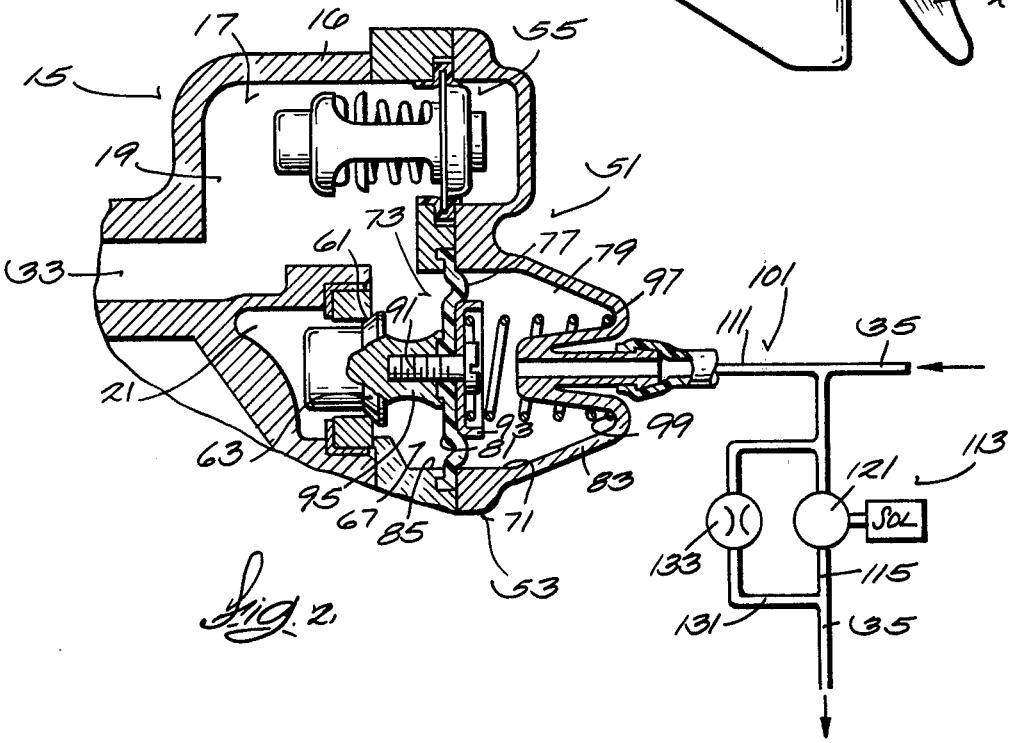
FIG. 2 is an enlarged, partially schematic view of a portion of the cooling system embodied in the outboard motor shown in FIG. 1.

Shown in the drawings is a marine propulsion device in the form of an outboard motor 11 which comprises a power head 13 including an internal combustion engine 15 having a block 16 including wall means defining a cooling jacket 17 having (See FIG. 2) an inlet portion 19 and a second or other or outlet portion 21. In addition, the outboard motor 11 includes a lower unit 25 which depends from and receives power from the powerhead 13 and includes a propeller 27. The propeller 27 is driven from the engine 15 by a drive shaft 29 which also powers a water pump 31 which, when the propeller 27 is immersed in water and the engine 15 is running, communicates with the water and delivers cooling water through a supply conduit 33 to the inlet portion 19 of the cooling jacket 17.

Preferably, the supply conduit 33 includes a restricted branch conduit 35 which, when the engine 15 is running and the water pump 31 is driven, constantly provides a visually apparent overboard discharge of water, thereby informing the operator of the operating status of the engine 15 and water pump 31.

As the water pump 31 is commonly directly driven by the engine 15, the discharge pressure of the pump is, at least through a portion of the range of engine speed, proportion to engine speed.

The engine 15 also includes a throttle valve 41 which is mounted on a shaft 43 and is connected by a suitable linkage 45 (shown schematically) with a speed control lever 47 which is accessible to the operator and which can be located remotely from the engine 15.

Means 51 are provided for controlling flow from the inlet portion 19 to the second portion 21 of the cooling jacket 17. While various constructions can be employed, in the illustrated construction, both a pressure actuated valve means 53 and a thermostatically actuated valve means 55 are arranged in parallel between the inlet portion 19 and the second portion 21 of the cooling jacket 17. The thermostatically actuated valve means 55 remains closed to prevent flow from the inlet portion 19 to the second portion 21 of the cooling jacket 17 in the absence of a water temperature above a predetermined level. Any suitable thermostatic valve means for controlling coolant or water flow from the inlet portion 19 to the second portion 21 of the cooling jacket 17 can be employed.

While various constructions can be employed, in the illustrated construction, the pressure actuated valve means 53 comprises a valve port 61 which extends between the inlet portion 19 and the second portion 21 of the cooling jacket 17, together with a valve member 63 which is suitably supported for movement between positions opening and closing the valve port 61, whereby to control coolant or water flow therethrough.

The pressure actuated valve means 53 also includes means 67 connected to the valve member 63 and subject to the application of pressure fluid independent of the water pressure in the inlet portion 19 for effecting or causing movement of the valve member 63 between the open and closed positions. While various arrangements can be employed, in the illustrated construction, such means 67 comprises provision in the engine block or otherwise of wall means defining a recess 71 which extends from the inlet portion 19 in spaced relation to the valve port 61 and in the direction of the movement of the valve member 63, together with a movable wall 73 connected to the valve member 63 so as to cause movement of the valve member 63 in response to movement of the movable wall 73. The movable wall 73 is supported by the engine block and extends across the recess 71 so as to define, on one side 77 thereof, a chamber 79 located in the recess 71. The movable wall 73 is also subject, on the other side 81 thereof, to the pressure of the coolant or water in the inlet portion 19 of the cooling jacket 17.

While various movable wall constructions can be employed, in the illustrated construction, the movable wall 73 comprises a flexible diaphragm which is supported at its periphery. In particular, the recess 71 is provided by a recessed member 83 which is bolted or otherwise suitably connected to the engine block 16 around an opening 85 therein communicating with the inlet portion 19 of the cooling jacket 17 and which, together with the engine block 16, captures the periphery of the movable wall or diaphragm 73 for support thereof.

While various arrangements can be employed, the diaphragm 73 is connected to the valve member 63 by means including a screw 91 which is seated against a cup-shaped member 93 located on the chamber side 77 of the diaphragm 73 and which extends through the diaphragm 73 and is threaded into the stem 95 of the valve member 63.

Desirably, means are provided for balancing a predetermined level of pressure in the coolant in the inlet portion 19 of the cooling jacket 17 and thereby to retain the valve member 63 in the closed position when the pressure in the inlet portion 19 of the cooling jacket 17 is below a specified or predetermined level. While various constructions can be employed, in the illustrated construction, such means comprises means 97 for biasing the diaphragm 73 so as to locate the valve member 63 in the closed position, which means, in the disclosed construction, is in the form of a helical compression spring which, at one end, bears against the cup shaped member 93 and which, at its other end, bears against the far wall 99 of the recess 71.

Means 101 are also provided for selectively applying pressure fluid to the means 67 for effecting movement of the valve member 63. While various arrangements can be employed, in the illustrated construction, such means comprises means for selectively applying pressure fluid to the chamber 79 including a duct or conduit 111 communicating with the chamber 79 and with a source of pressure fluid, such as water. While various pressure fluid sources can be employed, in the illustrated construction, the source of pressure fluid comprises employment of a portion of the output of the water pump, preferably that portion which is discharged overboard through the branch conduit 35 to provide a telltale indicating functioning of the engine 15 and the water pump 31. Thus in the disclosed construction, the conduit 111 communicates with the branch conduit 35.

The means 101 for selectively applying pressure fluid to the chamber 79 further includes valved vent means 113 communicating with the conduit 111 and operable selectively to progressively open and close the conduit 111 to the atmosphere and thereby to decrease and increase the pressure in the conduit 111. While various arrangements can be employed, in the illustrated construction, such means 113 comprises a portion 115 of the branch conduit 35 downstream of the connection with the conduit 111 and location of a suitably control valve 121 in the conduit portion 115 downstream of the connection with the conduit 111. Accordingly, when the control valve 121 is closed, the fluid pressure in the overboard discharge water branch conduit 35 will be applied to the chamber side 77 of the diaphragm 71, thereby keeping the valve member 63 closed against a water pressure in the intake portion 19 of the coolant jacket 17 above the pressure balanced by the spring 97. When the control valve 121 is opened, the pressure applied by the water in the chamber 79 to the chamber side 77 of the diaphragm 71 is reduced and approaches zero. Of course, partial opening or closing of the control valve 121 serves to apply a partial or intermediate pressure to the chamber side 77 of the diaphragm 71.

Any suitable control valve 121 and any suitable means for operating the control valve 121 can be employed. For instance, the control valve 121 can be a normally closed solenoid operated valve and can be electrically energized for opening thereof, either totally or progressively, in response to closure of a switch (not shown) incident to movement of some engine speed controlling member, such as the speed control lever 47 located remotely from the engine 15, or the throttle valve shaft 43, or any member in the linkage 45 interconnecting the control lever 47 and the throttle valve shaft 43.

Preferably, in order to maintain visual indication of the running condition of the engine 15 and the water pump 31 when the valve 121 is closed, a bypass duct 131 is connected to the branch conduit portion 115 in bypassing relation to the control valve 121 and includes therein a restriction 133 which continuously permits a limited flow of water through the bypass duct 131 without adversely reducing the pressure in the duct 35 upstream of the closed valve 121.

In operation of the disclosed cooling system, when the engine 15 is running at low speeds, the control valve 121 is closed and the pressure actuated valve means 53 will accordingly remain closed due to the action of the spring 97 and the application of water under pressure to the chamber side 79 of the diaphragm 71. However, at some desirable point in the speed range of the engine 15, the control valve 121 is opened by energizing the solenoid coil in response to engine speed control, thereby permitting free flow of water through the branch conduit 35 and causing diminished application of pressure to the chamber side 77 of the diaphragm 71, thereby permitting opening of the pressure actuated valve means 53 by the water pressure in the inlet portion 19 of the cooling jacket 17 whenever the pressure exceeds the predetermined level counterbalanced by the spring 97.

Full circulation of water through the cooling or water jacket 17 is then permitted regardless of the water temperature. When the setting of the throttle valve 41 is reduced, the control valve 121 is deenergized and returns to the closed position, causing application of increased pressure on the chamber side 77 of the diaphragm 71 and thereby causing reclosing of the valve member 63 relative to the valve port 61.

Various of the features of the invention are set forth in the following claims:

I claim:

1. A marine propulsion device comprising a power head including an internal combustion engine having a water jacket with an inlet portion, a second portion, and a valve port communicating between said inlet portion and said second portion, a valve member movable relative to said valve port between open and closed positions, a recess extending from said inlet portion, a movable wall connected to said valve member for actuation thereof between said open and closed positions, said movable wall having opposite first and second sides and extending across said recess to define, on said first side thereof, a chamber located in said recess, and being subject, on said second side thereof, to the pressure of the water in said inlet portion, and a lower unit connected to said power head and including a propeller submerged in water during normal operation, a water pump driven by said engine, having a discharge outlet, and communicating with the water during normal operation, a water supply conduit communicating with said discharge outlet and with said inlet portion of said water jacket, said water supply conduit including an overboard discharge branch conduit communicating with the atmosphere, a duct communicating with said chamber and with said overboard discharge branch conduit, and valve means in said overboard discharge branch conduit downstream of the connection with said duct and operable selectively to open and close said overboard discharge branch conduit relative to the atmosphere.

2. A marine propulsion device according to claim 1 wherein said movable wall comprises a flexible diaphragm.

3. A marine propulsion device in accordance with claim 1 and further including a bypass duct connected to said overboard discharge branch conduit and extending in bypassing relation to said valve means and including therein restriction means for continuously permitting a limited flow of water through said bypass duct.

4. A marine propulsion device in accordance with claim 1 wherein said valve means comprises a solenoid operated valve which is normally closed and which is opened in response to increasing engine speed.

5. A marine propulsion device in accordance with claim 1 wherein said recess includes a far wall and further including a spring acting between said first side of said movable wall and said far wall of said recess.

6. An internal combustion engine comprising a coolant jacket including an inlet portion and a second portion, pressure actuated valve means including a valve port communicating between said inlet portion and said second portion of said coolant jacket, a valve member movable relative to said valve port between open and closed positions, means subject to the application of pressure independent of the coolant pressure in said inlet portion for effecting movement of said valve member between said open and closed positions, and means for selectively applying pressure to said means for effecting movement of said valve member.

7. An internal combustion engine according to claim 6 wherein said means for effecting movement of said valve member comprises a recess extending from said inlet portion, and a movable wall connected to said valve member for actuation thereof between said opened and closed positions, said movable wall having opposite first and second sides and extending across said recess to define, on said first side thereof, a chamber located in said recess, and being subject, on said second side thereof, to the pressure of the coolant in said inlet portion.

8. An internal combustion engine according to claim 7 wherein said movable wall comprises a flexible diaphragm.

9. An internal combustion engine in accordance with claim 7 wherein said means for selectively applying pressure comprises means for selectively supplying pressure fluid to said chamber.

10. An internal combustion engine in accordance with claim 9 and further including a branch conduit communicating with said conduit means and with the atmosphere and including said valve means and a bypass duct connected to said branch conduit and extending in bypassing relation to said valve means and including therein restriction means for continuously permitting a limited flow of pressure fluid through said bypass duct.

11. An internal combustion engine in accordance with claim 8 wherein said recess includes a far wall and said means for effecting movement of said valve member includes a spring acting between said first side of said diaphragm and said far wall of said recess.

12. An internal combustion engine comprising a coolant jacket including an inlet portion and a second portion, pressure actuated valve means including a valve port communicating between said inlet portion and said second portion of said coolant jacket, a valve member movable relative to said valve port between open and closed positions, a recess extending from said inlet portion, and a movable wall connected to said valve member for actuation thereof between said opened and closed positions, said movable wall having opposite first and second sides and extending across said recess to define, on said first side thereof, a chamber located in said recess, and being subject, on said second side thereof, to the pressure of the coolant in said inlet portion, conduit means communicating with said chamber and adapted for connection to a source of pressure fluid, and valve means communicating with said conduit means and operable selectively to open and close said conduit means relative to the atmosphere.

13. An internal combustion engine in accordance with claim 12 wherein said valve means comprises a solenoid operated valve which is normally closed and which is opened in response to increasing engine speed.

14. An internal combustion engine comprising a coolant jacket including an inlet portion and a second portion, pressure actuated valve means including a valve port communicating between said inlet portion and said second portion of said coolant jacket, a valve member movable relative to said valve port between open and closed positions, means subject to the application of pressure independent of the coolant pressure in said inlet portion for effecting movement of said valve member between said open and closed positions, and means for selectively applying pressure to said means for effecting movement of said valve member, said means for selectively applying pressure including a valve controlling the application of the independent pressure to said valve member movement effecting means and being responsive to engine speed.

* * * * *